US009874315B1

(12) United States Patent
Lin

(10) Patent No.: US 9,874,315 B1
(45) Date of Patent: Jan. 23, 2018

(54) SAFETY LED LAMP

(71) Applicant: Chin-San Lin, Taipei (TW)

(72) Inventor: Chin-San Lin, Taipei (TW)

( * ) Notice: Subject to any disclaimer, the term of this patent is extended or adjusted under 35 U.S.C. 154(b) by 2 days.

(21) Appl. No.: 15/241,033

(22) Filed: Aug. 18, 2016

(51) Int. Cl.

| | |
|---|---|
| ***F21K 9/237*** | (2016.01) |
| ***F21K 9/232*** | (2016.01) |
| ***F21K 9/238*** | (2016.01) |
| ***F21K 9/66*** | (2016.01) |
| ***F21V 31/00*** | (2006.01) |
| ***F21V 25/00*** | (2006.01) |
| *F21Y 115/10* | (2016.01) |

(52) U.S. Cl.
CPC ..... *F21K 9/237* (2016.08); *F21K 9/232* (2016.08); *F21K 9/238* (2016.08); *F21K 9/66* (2016.08); *F21V 25/00* (2013.01); *F21V 31/005* (2013.01); *F21Y 2115/10* (2016.08)

(58) Field of Classification Search
CPC . F21K 9/66; F21K 9/238; F21K 9/232; F21K 9/237; F21V 25/00; F21V 31/005
See application file for complete search history.

(56) References Cited

U.S. PATENT DOCUMENTS

| | | | | |
|---|---|---|---|---|
| 9,052,068 | B2 * | 6/2015 | Wang | F21V 23/06 |
| 9,657,928 | B1 * | 5/2017 | Jacobson | F21V 23/04 |
| 2014/0056001 | A1 * | 2/2014 | Hsu | F21V 23/006 362/249.02 |

* cited by examiner

*Primary Examiner* — Anne Hines
(74) *Attorney, Agent, or Firm* — Leong C. Lei

(57) ABSTRACT

A safety LED lamp includes a shell, an LED light source arranged in an interior space of the shell, and a base. The safety LED lamp also includes a light-transmitting protective enclosure, which is mounted inside the shell and is arranged outside the LED light source to enclose the LED light source. The protective enclosure is made of a plastic material. Compared to the prior art, the safety LED lamp includes an arrangement that additionally includes the protective enclosure that is arranged inside the shell to enclose the LED light source and is made of plastics so that when the shell is broken, the LED light source that is enclosed by the plastic protective enclosure is prevented from direct contact with the external surrounding environment and potential risk of causing threats to the users is eliminated.

12 Claims, 4 Drawing Sheets

SAFETY LED LAMP

(a) TECHNICAL FIELD OF THE INVENTION

The present invention relates generally to a light-emitting diode (LED) based light source, and more particularly to a safety LED lamp.

(b) DESCRIPTION OF THE PRIOR ART

An LED based light source can made in the form an LED lighting strip to mimic or replace a filament of an incandescent light bulb and can be structured to form an LED bulb, which can be similar to an incandescent light bulb, by involving a positioning post to hold and position the LED lighting strip and being combined with a bulb shell and a head or a base. In this way, an existing manufacture line that is arranged for incandescent light bulbs can be used to manufacture LED lamps with only the LED lighting strips being separately made. This allows for conversion and re-use of an existing manufacturing line and the expenditure of switching between two separately installed manufacturing line could be reduced.

The shell of the LED light source is generally made of glass and is fragile and easy to break. When the shell is broken, if the LED light source is not damaged and maintains operable, then the exposed LED light source may cause potential danger to the users if it is allowed to be in continuous operation. On the other hand, if the LED light source and the positioning post are also damaged or broken, then the damaged or broken LED light source and positioning post may cut and hurt the users due to inadvertence.

Thus, it is desired to have an LED lamp that can be used and operated in a safer manner in order to protect users from potential threat of broken LED lamps.

SUMMARY OF THE INVENTION

An object of the present invention is to provide a safety light-emitting diode (LED) lamp that reduces or eliminates undesired threat to users by a broken LED lamp.

To achieve the above object, the present invention discloses a safety LED lamp, which comprises a shell, an LED light source arranged in an interior space of the shell, and a base. The safety LED lamp further comprises a light-transmitting protective enclosure. The protective enclosure is mounted inside the shell and the protective enclosure is fixedly arranged outside the LED light source to enclose and shield the LED light source. The protective enclosure is made of a plastic material.

Compared to the prior art, the present invention provides a safety LED lamp, which comprises a protective enclosure additionally provided inside the shell to enclose and shield an LED light source and the protective enclosure is made of a plastic material so that when the shell is broken, the LED light source that is enclosed by the plastics-made protective enclosure is prevented from direct contact with the external surrounding environment thereby eliminating potential risk of threatening the safety of users by the LED light source.

Preferably, the safety LED lamp further comprises a positioning post, where the positioning post has an end inserted into the interior space of the shell through an opening formed in the shell for supporting the LED light source. The protective enclosure is fixedly mounted on the positioning post.

Preferably, the protective enclosure encloses and shields an end of the positioning post that extends into the shell. On the one hand, the positioning post supports and retains the protective enclosure in position, and on the other hand, the protective enclosure encloses and shields the end of the positioning post extending into the shell.

Preferably, the safety LED lamp further comprises a power supply module. The power supply module is electrically connected to the LED light source. The power supply module and the LED light source are enclosed by the shell. The end of the positioning post that extends into the shell supports and retains the LED light source and the power supply module in position and the positioning post sealed and closes the opening of the shell. By arranging the power supply module, which functions for current rectification and voltage reduction, together with the LED light source, inside the shell such that the power supply module and the LED light source are enclosed by the shell, the power supply module and the LED light source are isolated from the external surrounding environment so as to provide the safety LED lamp with better waterproofness.

Preferably, the positioning post has an outer circumference that is arranged to hermetically close the opening of the shell. In an embodiment, the positioning post and the shell are fused to joint to each other in order to show a hermetic closure condition so that the positioning post positions the LED light source and the power supply module mounted thereon inside the shell and the positioning post and the opening of the shell are fused to joint to each other in order to isolate the LED light source and the power supply module from the external surrounding environment.

It is appreciated that in an alternative embodiment that is different from the previous embodiment, the positioning post and the opening of the shell can be sealed in hermetic connection with sealing adhesives. This way is a simple process; however, the connection achieved with the sealing adhesive is closely related to waterproofness of the safety LED lamp. Although hermetic connection with sealing adhesive is a simple process, quality inconsistency of products of safety LED lamps according to the present invention may become a major concern.

Preferably, the positioning post is provided, in the interior thereof, with an evacuation tube for evacuation of the shell or filling insert gas into the shell. The evacuation tube has an outer circumference connected, in a hermetic manner, to the positioning post and the evacuation tube is in a closed form. Vacuum or insert gas filled in the shell helps effectively extend the lifespan of the safety LED lamp according to the present invention.

Specifically, the protective enclosure is provided with an air passage communicating with the interior space of the shell and the interior space of the protective enclosure. The arrangement of the air passage allow for simultaneous evacuation of gas from the interior space of the shell and the interior space of the protective enclosure during evacuation conducted with the evacuation tube.

In an embodiment, the conductor wires that are electrically connects the LED light source and the power supply module are arranged to extend outside the protective enclosure and electrically connect with the base. In an alternative embodiment different from the previous embodiment, the conductor wires that electrically connect the LED light source and the power supply module penetrates through the positioning post to extend outside the shell.

Preferably, the shell and the base are adhesive bonded to each other. The shell provides an enclosed environment that isolates the external surrounding environment from the LED light source, the power supply module so that coupling between the shell and the base does not significantly influence waterproofness of the safety LED lamp according to the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
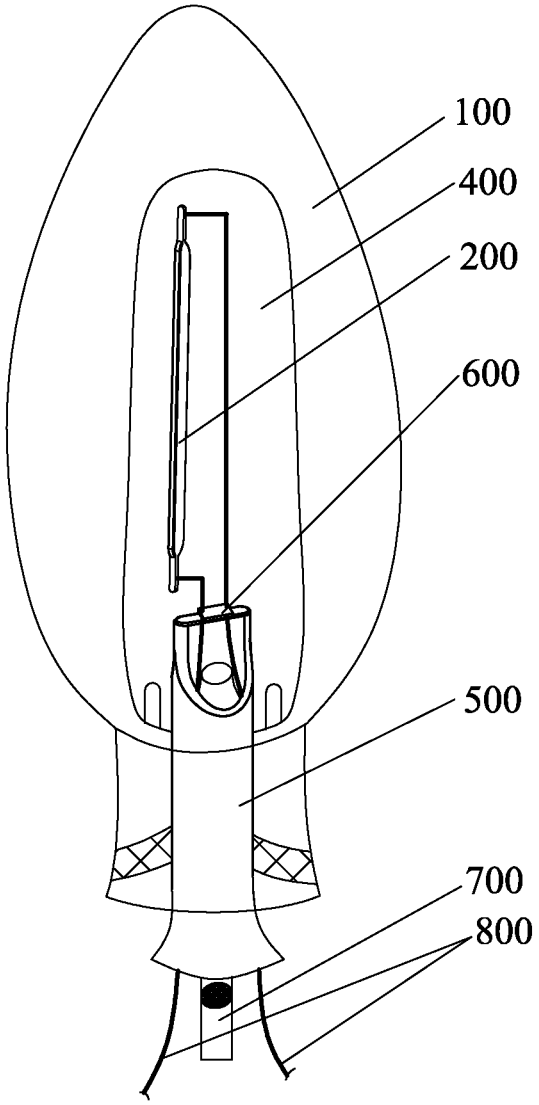
FIG. 2 is a schematic view illustrating the safety LED lamp according to the present invention with a base removed.
Figure 3:
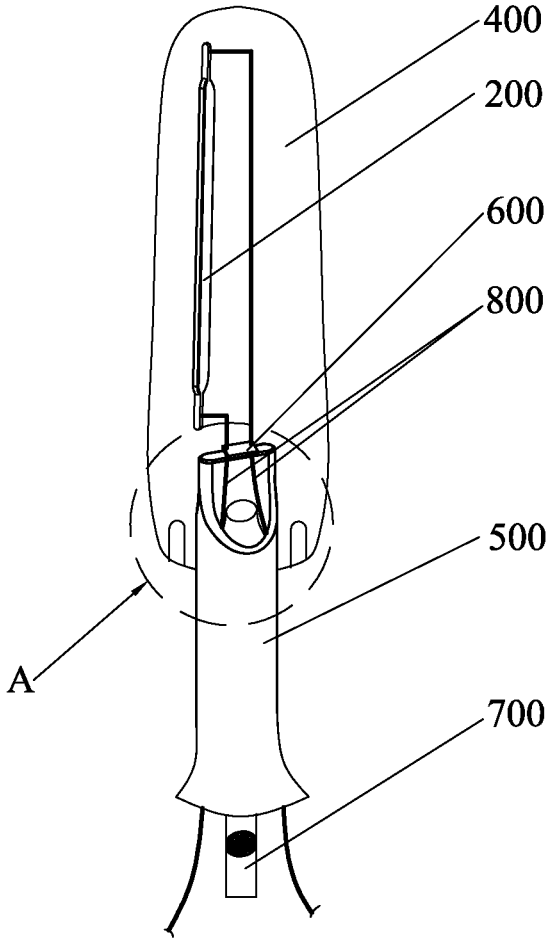
FIG. 3 is a schematic view illustrating an LED light source of the safety LED lamp according to the present invention in a condition of being shielded by a protective enclosure.
Figure 4:
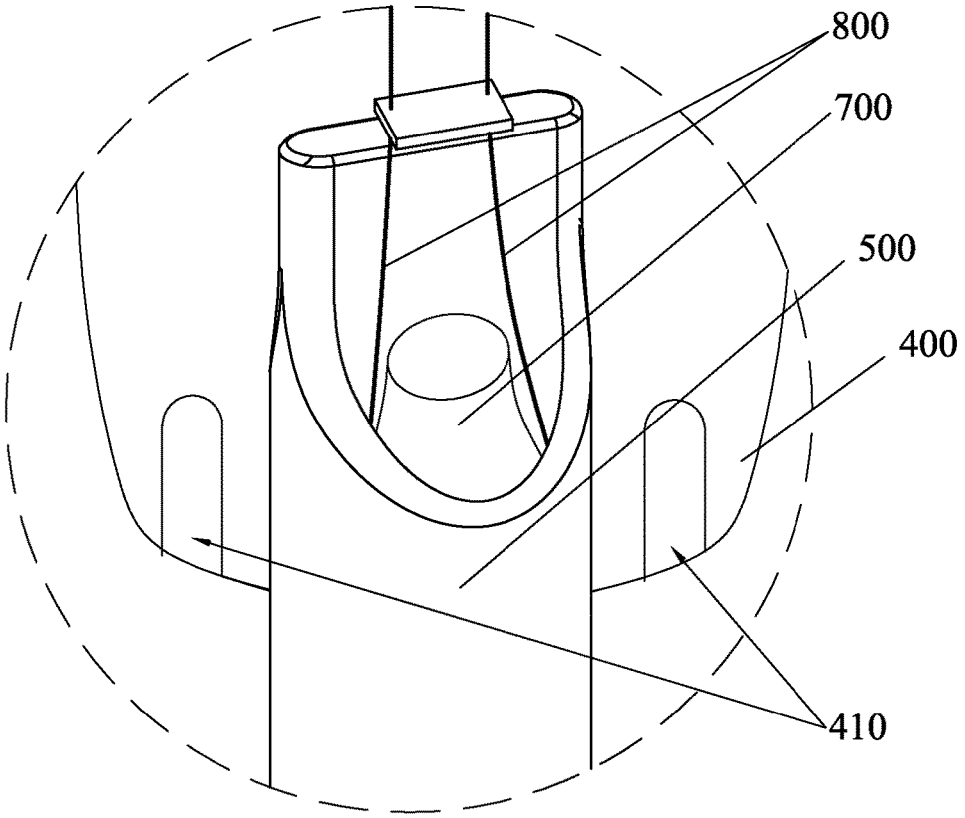
FIG. 4 is an enlarged view of a circled portion A of FIG. 3.

As shown in FIG. 3, the present invention provides a safety LED lamp, which comprises a shell 100, a light-emitting diode (LED) light source 200 arranged in an interior space of the shell 100, a base 300, a protective enclosure 400, a positioning post 500, a power supply module 600, an evacuation tube 700, and conductor wires 800. The protective enclosure 400 is light transmitting and the protective enclosure 400 can be made of a plastic material. The protective enclosure is arranged in the interior space of the shell and the protective enclosure is fixedly arranged outside the LED light source to enclose, house, and shield the LED light source. More details will be provided with reference to FIGS. 1-4.

Figure 1:
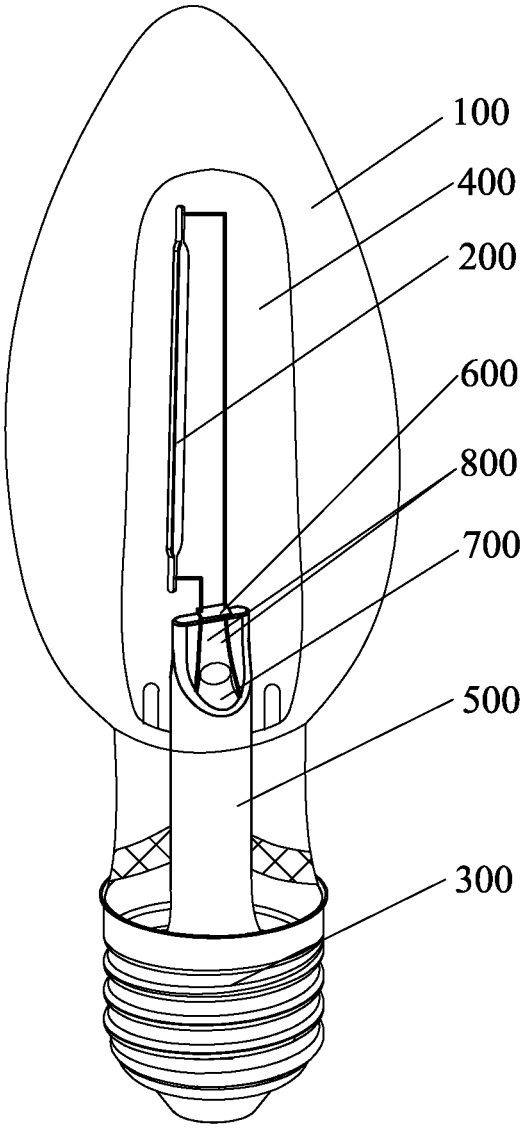
FIG. 1 is a schematic view showing a safety light-emitting diode (LED) lamp according to the present invention.

As shown in FIG. 1, the positioning post 500 comprises a rigid or stiff structure and the LED light source 200 and the power supply module 600 are both mounted on the positioning post 500 such that the LED light source 200, the power supply module 600, and the positioning post 500 are securely fixed to each other. As shown in FIGS. 1 and 2, the power supply module 600 is fixedly mounted to the positioning post 500 and the power supply module 600 is electrically connected between the LED light source 200 and the base 300. The arrangement of the power supply module 600 is for voltage regulation and current rectification in order to regulate electrical power supplied from an external power supply connected to the base 300 to meet the needs and specification of the LED light source 200. It can be appreciated that the power supply module 600 may comprise voltage dropping resistors, fuses, regulators, and the likes.

In an embodiment, the conductor wires 800, which are of predetermined stiffness, are arranged in an interior space of the protective enclosure 400 and are positioned by the positioning post 500 so that the conductor wires 800 that are located inside the protective enclosure 400 is a suspending manner for connection with and supporting the LED light source 200 in position. In alternative embodiments that are different from the above discussed embodiment, other measures may be taken to achieve positioning of the LED light source 200, such as bed directly supported by the positioning post 500, under such a condition, the conductor wires 800 functions for only electrical connection with the LED light source 200, the power supply module 600, and the base 300.

Preferably, the conductor wires 800 are electrically connected with the LED light source 200 and the power supply module 600, and the conductor wires 800 extend outside the protective enclosure 400 to electrically connect with the base 300, so as to establish and provide electrical connection between the LED light source 200 and the power supply module 600 that are located inside the protective enclosure 400 and the base 300 that is located outside the protective enclosure 400. Further, the conductor wires 800 that electrically connect the LED light source 200 and the power supply module 300 extends through the positioning post 200 to get outside the shell 100. It is appreciated that the purpose of the conductor wires 800 electrically connecting the LED light source 200, the power supply module 300, and the base 300 can be achieved provided the conductor wires 800 are extended outside the protective enclosure 400 and the shell 100. The specific arrangement and location where the conductor wires 800 extend outside the protective enclosure 400 and the shell 100 can be determined according to practical requirement or as desired. Referring collectively to FIGS. 1 and 2, the positioning post 500 that supports the LED light source 200 and the power supply module 600 thereon is inserted into the shell 100 through an opening formed in the shell 100 in such a way that the positioning post 500 that is so inserted closes and covers the opening of the shell 100. Specifically, an outer flange of the positioning post 500 is coupled to a circumference of the opening of and the shell 100 in a sealed and closed manner so that the shell 100 may house, in a sealed or hermetic manner, the power supply module 600 and the LED light source 200 therein.

Referring additionally to FIG. 3, the protective enclosure 400 is fixedly mounted on the positioning post 500. The protective enclosure 400 encloses, houses, and shields an end of the positioning post 500 that is inserted into the shell 100. Specifically, the protective enclosure 400 is of a structure in the form of a hollow casing having an opening such that the protective enclosure 400 may be fit, through the opening thereof, over and attached to the positioning post 500 to enclose, house, and shield the end of the positioning post 500 inserted into the shell 100 so that the protective enclosure 400 can enclose, house, and shield the LED light source 200 and, also, the protective enclosure 400 can be fixedly mounted ton the positioning post 500. The protective enclosure 400 that encloses, houses, and shields the LED light source 200 and the end of the positioning post 500 that is inserted into the shell 100 is made of a plastic material and the plastics-made protective enclosure 400 isolate the LED light source 200 such that the LED light source 200 is not allowed for direct access with the outside thereby preventing any potential threat to user's safety by the LED light source 200. Further, the protective enclosure 400, which is light transmitting, does not interfere with emission and outward projection of light from the LED light source 200.

Further, referring to FIG. 1, the positioning post 500 comprises a flaring or horn-like structure at an end distant from the LED light source 200 and the power supply module 600. The flaring structure has a shape and a size corresponding to the opening of the shell 100. The positioning post 500 that receives the LED light source 200 and the power supply module 600 mounted thereon is inserted through the opening of the shell 100 into the shell 100 such that the end of the positioning position 500 having the flaring structure is placed adjacent to the opening of the shell 100. The flaring structure allows for easy and hermetic connection or coupling with the opening of the shell 100. In an embodiment, heating may be applied, in a localized manner, to the end of the positioning post 500 having the flaring structure and the opening of the shell 100 to have the flaring end of the positioning post 500 and the shell 100 fused to each other and thus achieving sealing and hermetic connection between the positioning post 500 and the shell 100. In this way, the LED light source 200 and the power supply module 600 are separated and isolated from the outside environment. It is appreciated that in an alternative embodiment that is different from the previous embodiment, the positioning post 500 and the opening of the shell 100 can be sealed in a hermetic connection with sealing adhesives. This way is a simple process; however, the connection achieved with the sealing adhesive is closely related to waterproofness of the safety LED lamp. Although hermetic connection with sealing adhesive is a simple process, quality inconsistency of products of safety LED lamps according to the present invention may become a major concern.

As shown in FIG. 1, the positioning post 500 is provided, in the interior thereof, with an evacuation tube 700 that is mounted in a fixed manner. Specifically, the evacuation tube 700 is arranged to extend along a central bore formed in the positioning post 500. The arrangement of the evacuation tube 700 provides a gas channel between the interior space of the shell 100 and the outside environment. An operator is allowed to evacuate the interior space of the shell 100 or to fill inert gas into the shell 100 through the evacuation tube 700.

Further, the protective enclosure 400 is provided with an air passages 410 communicating with the internal space of the shell 100 and the internal space of the protective enclosure 400. The arrangement of the air passages 410 allows gas to be evacuated from both the internal space of the shell 100 and the internal space of the protective enclosure 400 during evacuation conducted through the evacuation tube 700.

Referring collectively to FIGS. 1 and 2 again, after evacuation of the interior space of the shell 100 through the evacuation tube 700 or after inert gas has been introduced through the evacuation tube into and filled up the interior space of the shell 100, heating and localized fusion may be similarly applied to close and seal the evacuation tube 700, or alternatively, adhesive or a blocking material may be used to close the evacuation tube 700. After the evacuation tube 700 is closed and sealed, the shell 100 is completely isolated from the external surrounding environment and the interior of the shell 100 is maintained in a vacuum condition or in an insert-gas-filled condition so as to allow the LED light source 200 to stably and securely operate inside the shell 100.

Further, referring additionally to FIG. 3, the conductor wires 800 that is electrically connected to the LED light source 200 and the power supply module 600 inside the shell 100 is electrically connected to the base 300 to allow the safety LED lamp of the present invention to connect the power supply module 600 to an external power supply. The sealing and closure of the shell 100 affect, to some extents, the arrangement of the conductor wires 800, and in this respect, the present invention provides the following solution: The conductor wires 800 that are electrically connected to the LED light source 200 and the power supply module 600 are allowed to penetrate through the positioning post 500 to extend out of the shell 100, and this allows localized heating, fusion, or sintering of the positioning post 500 to achieve a desired effect of sealing and closing the shell 100, or alternatively, adhesive, in a liquid or flowable form, may be applied to the site where the conductor wires 800 penetrates through the positioning post 500 such that the opening that may be small can be immediately filled up with the adhesive to achieve a similar effect of sealing and closure. In an alternative embodiment that is different from the previous embodiment, the conductor wires 800 that are electrically connected to the LED light source 200 and the power supply module 600 may be arranged to penetrate through the evacuation tube 700 for electrical connection with the base 300, so that sealing and closing the evacuation tube 700 through heating and fusion of the evacuation tube 700 or application of adhesive or a blocking material to the evacuation tube 700 would also achieve an effect of positioning and retaining the conductor wires 800 in position.

As shown previously, the shell 100 provided an enclosed environment that isolates the external surrounding from the LED light source 200 and the power supply module 600. Coupling of the shell 100 and the base 300 to each other would not greatly affect waterproofness of the safety LED lamp according to the present invention. In the instant embodiment, the shell 100 and the base 300 are adhesively bonded and coupled to each other and preferably, two-component adhesives may be used. It is certain that any other known means that could fixedly connect the two together can be used.

Compared to the prior art, the present invention provides a safety LED lamp, which comprises a protective enclosure 400 additionally provided inside a shell 100 to enclose and shield an LED light source 200, where the protective enclosure 400 is made of a plastic material, so that in case that the shell 100 is broken, the LED light source 200 that is enclosed by the plastics-made protective enclosure 400 is prevented from direct contact with the external surrounding environment thereby eliminating potential risk of threatening the safety of users by the LED light source 200. By arranging a power supply module 600 that functions for current rectification and voltage reduction, together with the LED light source 200, inside the shell 100 such that the power supply module 600 and the LED light source 200 are both enclosed, in a hermetic manner, by the shell 100, whereby the power supply module 600 and the LED light source 200 are isolated from the external surrounding environment and excellent waterproofness of the safety LED lamp according of the present invention can be achieved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A safety light-emitting diode (LED) lamp, comprising a shell, an LED light source arranged in an interior space of the shell, a base, a protective enclosure, a positioning post, a power supply module, an evacuation tube, and conductor wires, the shell having an open bottom that forms an opening, the opening being mounted to the base, the positioning post comprising a rigid structure, the positioning post having an end extending through the opening of the shell into the shell, the positioning post comprising a central bore formed therein and having a bottom forming a flaring structure and in hermetic connection with the opening of the shell, the protective enclosure being light transmitting and in the form of a hollow casing having a bottom forming an opening such that the bottom opening is fixedly mounted to an upper end of the positioning post, the protective enclosure being arranged outside the LED light source to enclose and shield the LED light source, the LED light source and the power supply module being positioned on the positioning post such that the LED light source, the power supply module, and the positioning post are securely fixed to each other, the power supply module being electrically connected between the LED light source and the base, the conductor wires being arranged in the protective enclosure and possessing stiffness and being mounted to the positioning post in a suspending form for connection with and positioning the LED light source, the evacuation tube being arranged in the internal central bore of the positioning post.

2. The safety LED lamp according to claim 1, wherein the protective enclosure encloses and shields an end of the positioning post that extends into the shell.

3. The safety LED lamp according to claim 2, wherein the shell and the base are adhesively coupled to each other.

4. The safety LED lamp according to claim 1, wherein the positioning post has an outer flange formed in the bottom thereof and fused to the opening of the shell in a sealed condition.

5. The safety LED lamp according to claim 4, wherein the shell and the base are adhesively coupled to each other.

6. The safety LED lamp according to claim 1, wherein the conductor wires that are electrically connects the LED light source and the power supply module extend outside the protective enclosure and are electrically connected to the base.

7. The safety LED lamp according to claim 6, wherein the shell and the base are adhesively coupled to each other.

8. The safety LED lamp according to claim 1, wherein the positioning post comprises an evacuation tube arranged therein for evacuation of the shell or filling inert gas into the shell, the evacuation tube having an outer circumference connected, in a sealed condition, to the positioning post, the evacuation tube being in a closed form.

9. The safety LED lamp according to claim 8, wherein the protective enclosure comprises an air passage formed therein and in communication with the interior space of the shell and the interior space of the protective enclosure.

10. The safety LED lamp according to claim 9, wherein the shell and the base are adhesively coupled to each other.

11. The safety LED lamp according to claim 8, wherein the shell and the base are adhesively coupled to each other.

12. The safety LED lamp according to claim 1, wherein the shell and the base are adhesively coupled to each other.

* * * * *